US008333385B2

(12) United States Patent
McGovern et al.

(10) Patent No.: US 8,333,385 B2
(45) Date of Patent: Dec. 18, 2012

(54) ARCHERY TARGET WITH THREE DIMENSIONAL TARGET AREA

(75) Inventors: James McGovern, Milton, WI (US); John R. Rinehart, Milton, WI (US)

(73) Assignee: J & L Targets, Inc., Janesville, WI (US)

( * ) Notice: Subject to any disclaimer, the term of this patent is extended or adjusted under 35 U.S.C. 154(b) by 160 days.

(21) Appl. No.: 12/895,542

(22) Filed: Sep. 30, 2010

(65) Prior Publication Data

US 2012/0080848 A1 Apr. 5, 2012

(51) Int. Cl.
*F41J 3/00* (2006.01)

(52) U.S. Cl. ..... 273/403

(58) Field of Classification Search ..... 273/403, 273/404, 408, 409; D21/302, 307
See application file for complete search history.

(56) References Cited

U.S. PATENT DOCUMENTS

| | | | | |
|---|---|---|---|---|
| 858,090 | A | | 6/1907 | Meinecke |
| 1,818,939 | A | | 8/1931 | Brading |
| 2,812,947 | A | | 11/1957 | Fatzinger et al. |
| 3,163,418 | A | | 12/1964 | Myers |
| 3,164,384 | A | | 1/1965 | Stewart |
| 3,203,698 | A | | 8/1965 | Saunders |
| 3,319,960 | A | | 5/1967 | Wilcox |
| 4,054,288 | A | | 10/1977 | Perrine, Sr. |
| 4,066,261 | A | | 1/1978 | Stewart |
| 4,239,236 | A | | 12/1980 | Parham et al. |
| 4,247,116 | A | | 1/1981 | McQuary |
| 4,477,082 | A | | 10/1984 | McKenzie et al. |
| 4,597,574 | A | | 7/1986 | Wolfe |
| 4,643,434 | A | * | 2/1987 | Carlin ..... 273/408 |
| 4,850,596 | A | | 7/1989 | Olund |
| 4,940,244 | A | | 7/1990 | Batts, III |
| 5,308,084 | A | | 5/1994 | Morrell |
| 5,383,671 | A | | 1/1995 | Teets et al. |
| 5,465,977 | A | | 11/1995 | Mann |
| 5,496,039 | A | | 3/1996 | Zammuto |
| 5,498,001 | A | | 3/1996 | Franks et al. |
| 5,503,403 | A | | 4/1996 | Morrell |
| 5,540,446 | A | | 7/1996 | Felsen |
| 5,649,708 | A | | 7/1997 | Podlesny |
| 5,669,610 | A | | 9/1997 | Salyers |
| 5,816,579 | A | | 10/1998 | Broussard et al. |

(Continued)

FOREIGN PATENT DOCUMENTS

| | | |
|---|---|---|
| GB | 0 639 503 | 6/1950 |

(Continued)

*Primary Examiner* — Mark Graham
(74) *Attorney, Agent, or Firm* — Foley & Lardner LLP

(57) ABSTRACT

The present disclosure relates to a portable archery target. The portable archery target includes a main target body having a geometric shape. The geometric shape has a first side and a second side. The first side has a first target zone, while the second side has a second target zone that is separate and distinct from the first target zone. At least one of the first target zone and the second target zone has a first three-dimensional animal-simulating indicia. The present disclosure also relates to a method of manufacturing a portable archery target. The method includes adding a resin into a mold cavity that defines a geometric shape of the portable archery target. The mold cavity has a first surface that defines a first target zone and a second surface that defines a second target zone. At least the first surface has a contour that provides a three-dimensional animal-simulating target. The method also includes closing the mold cavity to form a foam body and removing the foam body from the mold cavity.

17 Claims, 10 Drawing Sheets

U.S. PATENT DOCUMENTS

| | | | | |
|---|---|---|---|---|
| D423,597 | S | 4/2000 | Martin et al. | |
| D425,135 | S | 5/2000 | Quiring | |
| 6,068,261 | A * | 5/2000 | Nettle | 273/408 |
| 6,254,100 | B1 | 7/2001 | Rinehart | |
| D455,461 | S | 4/2002 | Huang | |
| D460,786 | S | 7/2002 | Wilson, Sr. | |
| 6,799,764 | B2 | 10/2004 | Ingold | |
| D525,312 | S | 7/2006 | Rinehart | |
| 7,380,796 | B1 * | 6/2008 | Hinton | 273/408 |
| 7,744,090 | B1 * | 6/2010 | Nettle | 273/403 |
| 2002/0113372 | A1 * | 8/2002 | Love | 273/408 |
| 2007/0029733 | A1 * | 2/2007 | Anderson | 273/408 |
| 2008/0054570 | A1 * | 3/2008 | Potterfield et al. | 273/403 |
| 2009/0039603 | A1 * | 2/2009 | Clark | 273/408 |

FOREIGN PATENT DOCUMENTS

| | | |
|---|---|---|
| WO | WO 90/15964 | 12/1990 |

* cited by examiner

ARCHERY TARGET WITH THREE DIMENSIONAL TARGET AREA

BACKGROUND

The present disclosure relates generally to an archery target configured to receive a pointed projectile, such as an arrow. More particularly, the present disclosure relates to an archery target providing a three-dimensional representation of at least a portion of an animal.

Archery targets formed as three-dimensional life-size animal simulating archery targets are intended to provide an archer with realistic hunting conditions. Such targets are generally formed of molded foam having a shape resembling that of a game animal, for example a deer or a bear. Due to their size and the level of detail included, such targets are often costly to manufacturer, as thus, are relatively expensive for consumers. Further, the size and weight of such targets make them relatively permanent structures, as opposed to being portable. Accordingly, there is a need for an archery target that provides a three-dimensional representation of at least a portion of an animal without the shortcomings of the three-dimensional life-size animal simulating archery targets.

SUMMARY

One exemplary embodiment of the present invention relates to a portable archery target. The portable archery target includes a main target body having a geometric shape. The geometric shape has a first side and a second side. The first side has a first target zone, while the second side has a second target zone that is separate and distinct from the first target zone. The first target zone has a first three-dimensional animal-simulating indicia, while the second target zone has a second three-dimensional animal-simulating indicia.

Another exemplary embodiment of the present invention relates to a portable archery target. The portable archery target includes a main target body having a first side and a second side. The first side defines a first target zone having a first three-dimensional animal-simulating indicia. The second side defines a second target zone having a substantially planar surface. The portable archery target also includes a replaceable target insert configured to be received within an aperture defined by the second side. The replaceable target insert has an outer surface that forms at least a portion of the second target zone when received within the aperture.

Another exemplary embodiment of the present invention relates to a method of manufacturing a portable archery target. The method includes adding a resin into a mold cavity that defines a geometric shape of the portable archery target. The mold cavity has a first surface that defines a first target zone and a second surface that defines a second target zone. The first surface has a contour that provides a three-dimensional animal-simulating target, while the second surface has a contour that provides a substantially planar target. The method also includes closing the mold cavity to form a foam body and removing the foam body from the mold cavity.

DETAILED DESCRIPTION

Referring generally to the FIGURES, an archery target 10 is shown according to an exemplary embodiment. The archery target 10 is a portable target having at least one surface that includes a three-dimensional animal-simulating target that is penetratable by a pointed projectile, such as an arrow (e.g., broadhead arrows, field point or target arrows, etc.). For purposes of this disclosure, the term three-dimensional, when used to describe a target zone, refers to a structure that protrudes or extends outwardly from the surface of the archery target 10 on which the target zone is supported. Providing a portable target with a three-dimensional animal-simulating target may provide a cost efficient alternative to a three-dimensional life-size animal-simulating archery target.

Before discussing the details of the archery target 10, it should be noted at the outset that references to "front," "back," "rear," "upper," "bottom," "right," and "left" in this description are merely used to identify the sides and/or surfaces of the archery target 10 as they are oriented in the FIGURES. The words "inwardly" and "outwardly" refer to directions toward and away from, respectively, the approximate center of the archery target and/or designated parts thereof. These terms are not meant to limit the element which they describe, as the various elements may be oriented differently in various applications. It should further be noted that for purposes of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Figure 1:
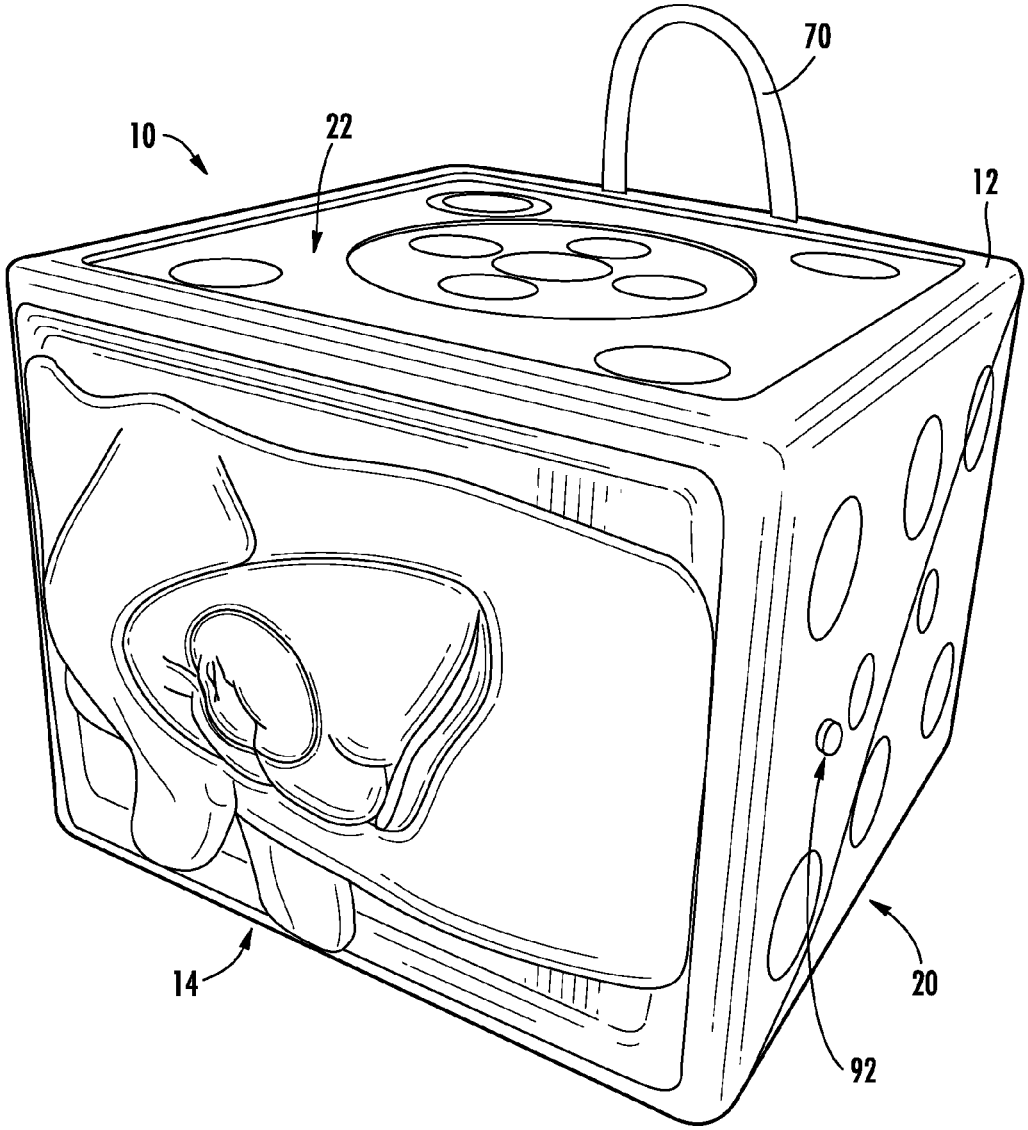
FIG. 1 is a perspective view of an archery target shown according to an exemplary embodiment showing a first side of the archery target.
Figure 2:
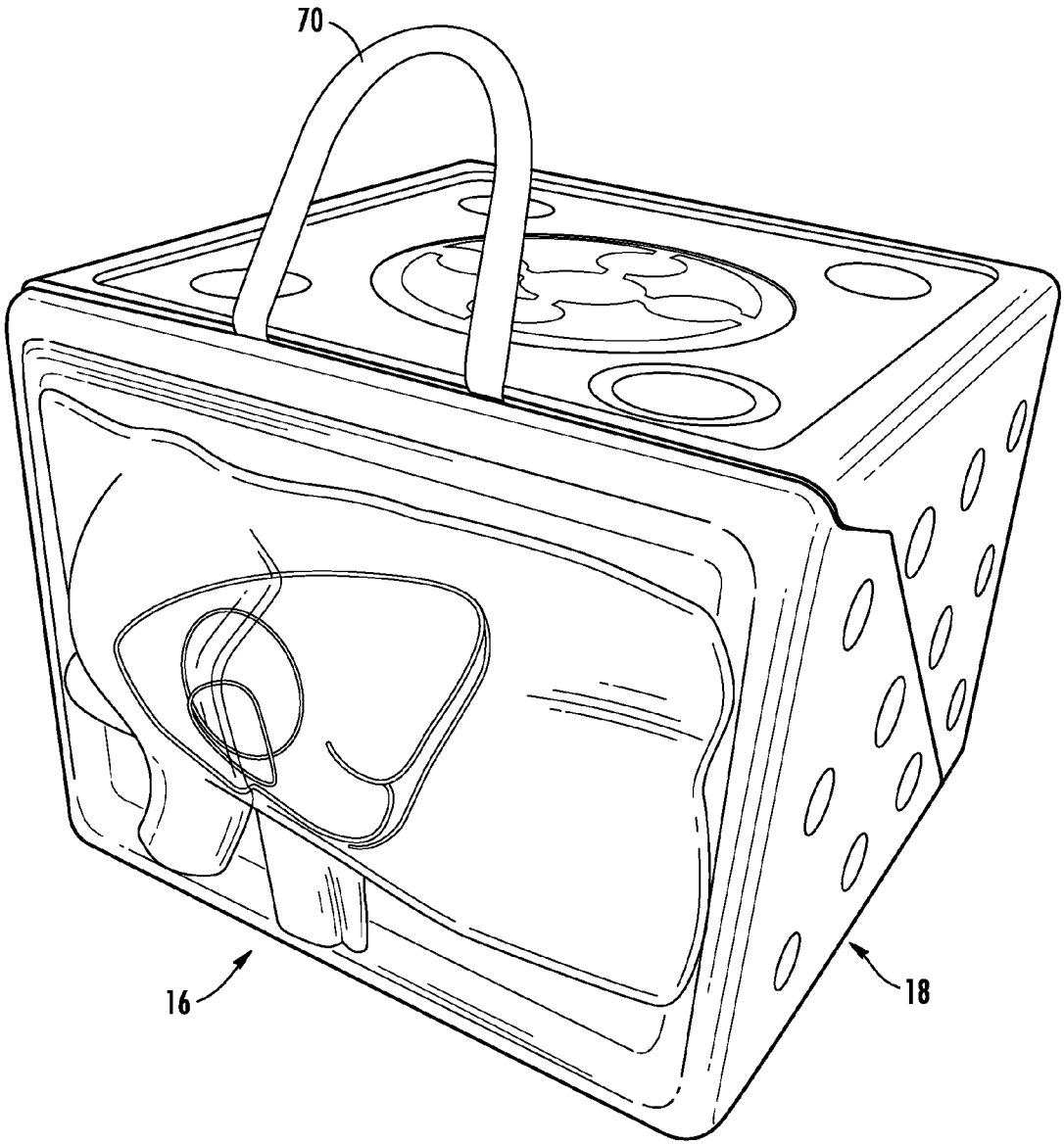
FIG. 2 is another perspective view of the archery target shown in FIG. 1 showing a second side of the archery target.

Referring to FIGS. 1 and 2, the archery target 10 includes a main target body 12 that defines an outer periphery of the archery target 10 and is configured to be penetrated by a pointed projectile. According to an exemplary embodiment, the main target body 12 is constructed of a molded polyurethane foam that is configured to quickly stop incoming projectiles and allows them to be pulled out or otherwise removed from the main target body 12 without requiring any sort of lubricant or removal device. Of course, other suitable foam or other materials may be used to form the main target body 12. According to an exemplary embodiment, the density of the polyurethane foam may be similar to the density of one or more parts of an actual animal so as to more closely simulate projectile penetration under hunting conditions. The density is likely to be substantially constant throughout the main target body 12, but alternatively, the density may vary in different locations, for example, if it would be desirable to provide different densities for different target zones.

The shape and size of the main target body 12 may vary depending on the particular application of the target. Preferably, the main target body 12 has a geometric shape that is sized so that the archery target 10 is relatively light and easy to transport (i.e., portable). According to an exemplary embodiment, the archery target 10 has a height that is approximately 13 inches and a width and depth that are approximately 16 inches. According to the various alternative embodiments, the archery target 10 may have dimensions greater than or less than those provided herein while still being sized to be portable. The main target body 12 has a plurality of sides or faces that may define one or more target zones. Providing a target with multiple sides and target zones offers versatility to an archer by enabling the archer to take any of a number of positions relative to the target. For example, the archer can shoot from above, below, in front of, or behind the target. Further, providing a target with multiple sides and target zones may allow a single target to be used for different types of practice (e.g., arrow placement, honing, etc.).

According to an exemplary embodiment, the main target body 12 is a six-sided object having a first face or side surface 14, a second face or side surface 16, a third face or side surface 18, a fourth face or side surface 20, a fifth face or side surface 22 and a sixth face or side surface 24. Each of the first side surface 14, the second side surface 16, the third side surface 18, the fourth side surface 20 the fifth side surface 22 and the sixth side surface 24 defines one or more target zones or areas configured to receive a pointed projectile, but alternatively, one or more of the side surfaces may not include a target zone. In addition to defining one or more target zones, the first side surface 14, the second side surface 16, the third side surface 18, the fourth side surface 20 the fifth side surface 22 and the sixth side surface 24 are also configured to rest upon the ground or some other surface to support the archery target 10 in a relatively stable position. Such a configuration allows an archer to selectively turn over or otherwise reposition the archery target 10 to reveal or conceal different target zones.

According to the embodiment illustrated, the first side surface 14, the second side surface 16, the third side surface 18, the fourth side surface 20 the fifth side surface 22 and the sixth side surface 24 are substantially planar surfaces that are aligned at approximately 90 degrees angles relative to adjacent side surfaces so as to form a substantially rectangular block. According to various alternative embodiments, the main target body 12 may formed into any of a number of geometric shapes (e.g., a cube, sphere, tetrahedron, prism, cylinder, cone, etc.) or other shapes, such as of an animal (e.g., a deer, bear, fox or other game animal, etc.).

The main target body 12 may be formed of one or more molded sections coupled together. According to an exemplary embodiment, the main target body 12 is integrally molded as a one-piece unitary member. Any suitable molding technique, employing molds of desired shape and size, may be used to form the main target body 12. If the main target body 12 is formed of more than one section, the sections can be coupled together using mechanical fasteners, solvents, cement, etc. Using a plurality of sections to define the main target body 12 may provide an efficient way to provide different densities within the same target if such a feature would be desirable.

Figure 3:
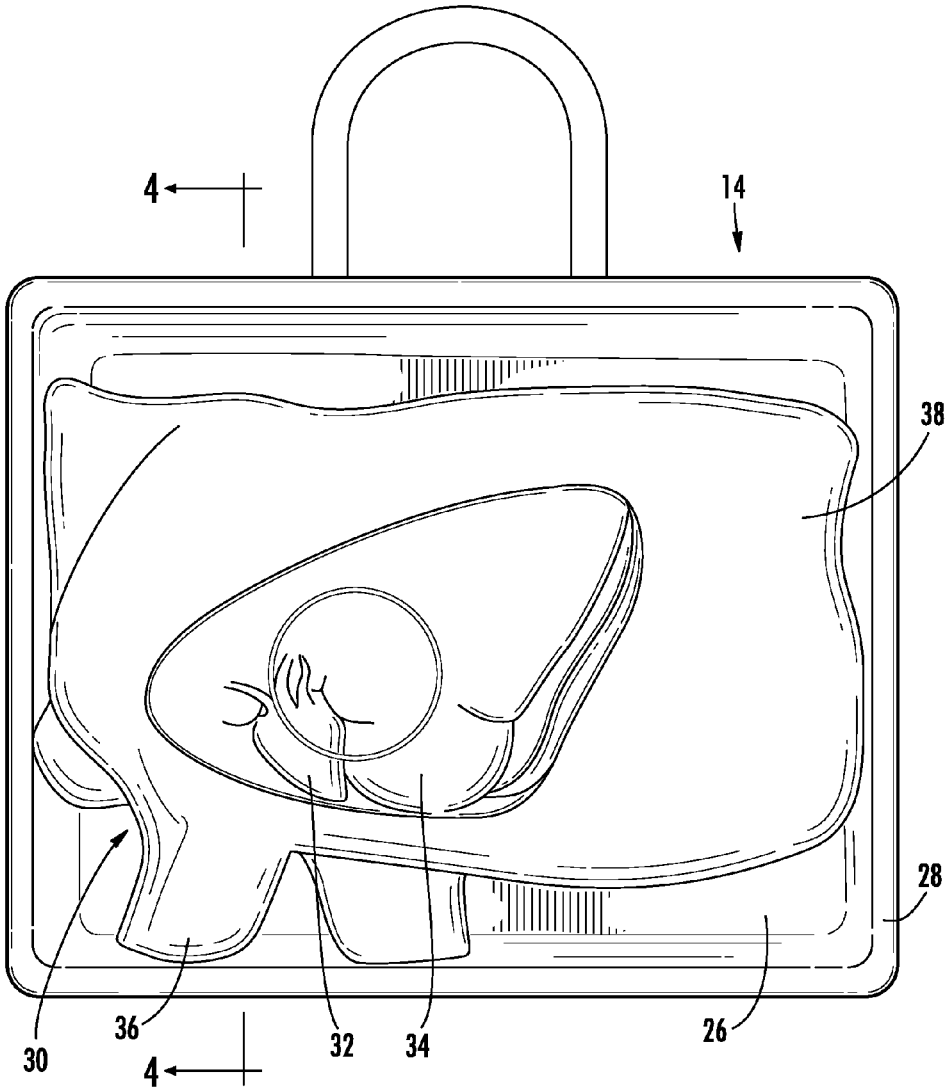
FIG. 3 is an elevation view of the first side of the archery target of FIG. 1.

Referring to FIG. 3, the first side surface 14 of the main target body 12 is shown according to an exemplary embodiment. The first side surface 14 includes a first target zone for an archer. The first target zone includes a first central region 26 that is at least partially surrounded by a first border region 28. According to an exemplary embodiment, the first central region 26 is recessed or extends inwardly relative to the first border region 28. In other words, the first border region 28 gives the appearance of being extended outwardly from the first central region 26. The first border region 28 is shown as extending continuously around the entire periphery of the first side surface 14. According to the various alternative embodiments, the first border region 28 may only extend partially (e.g., intermittently, etc.) around the first side surface 14 or may be eliminated entirely.

The first central region 26 has a planar surface shown as being a substantially flat surface. Provided on the first central region 26, and extending outwardly there from, is a first three-dimensional animal-simulating target 30. The first three-dimensional animal-simulating target 30 includes indicia representing one or more vital organs of an animal, such as a deer, bear, fox, etc. According to an exemplary embodiment, the first three-dimensional animal-simulating target 30 provides a detailed and anatomically correct representation of a heart 32 and a lung 34 of an animal, along with the legs 36 and body 38 of the animal. The outer surface of the first three-dimensional animal-simulating target 30 is contoured and textured to provide life-like representation of the animal to the archer. The outer surface of the first three-dimensional animal-simulating target 30 may be painted, and covered with a UV protectant material, to provide an even more realistic appearance. Providing the indicia as three-dimensional offers a more realistic experience for the archer.

Figure 4:
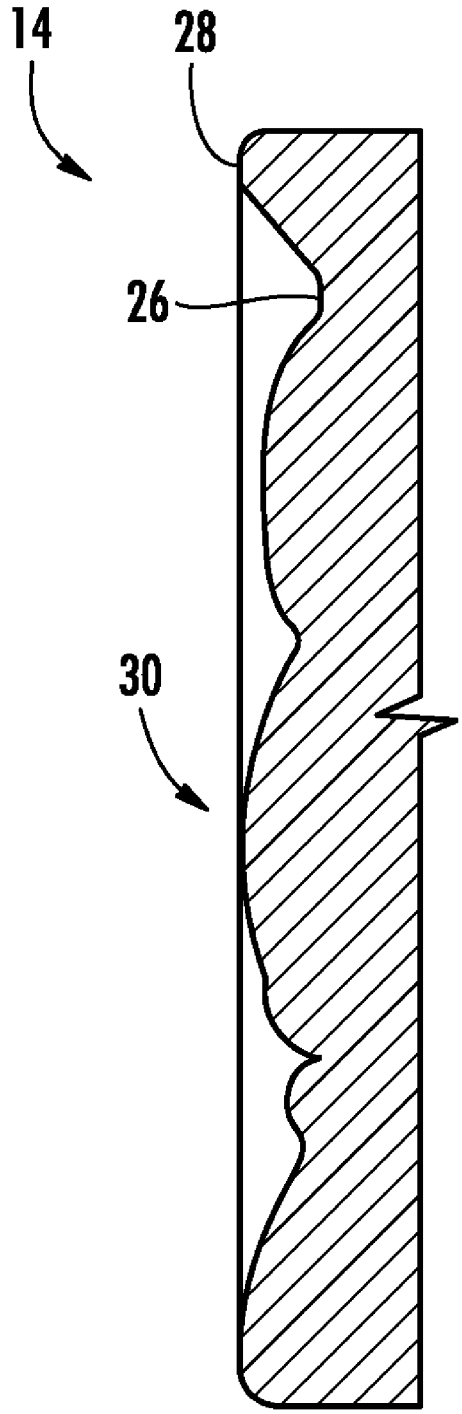
FIG. 4 is a cross sectional view of the first side of the archery target taken through a line 4-4 of FIG. 3.

FIG. 4 is a cross sectional view of the first side surface 14, which illustrates the first three-dimensional animal-simulating target 30 outwardly extending from the first central region 26. According to an exemplary embodiment, the first three-dimensional animal-simulating target 30 does not extend in an outwardly direction a distance beyond the first border region 28. According to the embodiment illustrated, the highest point of the first three-dimensional animal-simulating target 30 extends outwardly from the first central region 26 a distance that is substantially the same as a distance that the first border region 28 extends outwardly from the first central region 26. By not having the first three-dimensional animal-simulating target 30 extend outwardly beyond the height of the first border region 28, the archery target 10 can sit relatively flat when supported by the first side surface 14. Such a configuration enhance the stability of archery target 10, particularly if placed on a flat surface (e.g., ground, stand, table, etc.) during use.

Figure 5:
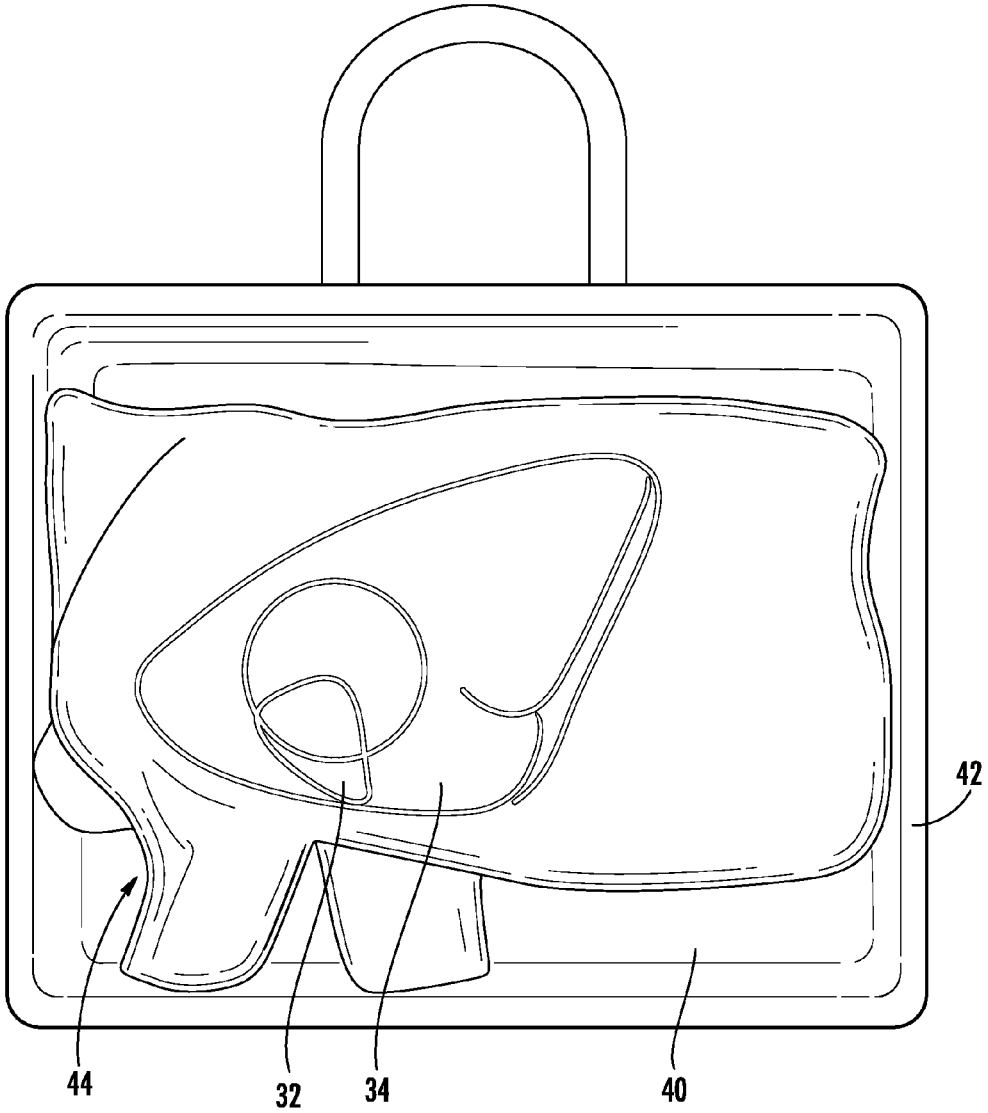
FIG. 5 is an elevation view of the second side of the archery target of FIG. 1.

Referring to FIG. 5, the second side surface 16 of the main target body 12 is shown according to an exemplary embodiment. The second side surface 16 is provided at a side opposite the first side surface 14, and includes a second target zone for an archer. The second target zone includes a second central region 40 that is at least partially surrounded by a second border region 42. According to an exemplary embodiment, the second central region 40 is recessed or extends inwardly relative to the second border region 42. In other words, the second border region 42 gives the appearance of being extended outwardly from the second central region 40. The second border region 42 is shown as extending continuously around the entire periphery of the second side surface 16. According to the various alternative embodiments, the second border region 42 may only extend partially (e.g., intermittently, etc.) around the second side surface 16 or may be eliminated entirely.

The second central region 40 has a planar surface shown as being a substantially flat surface. Provided on the second central region 40, and extending outwardly there from, is a second three-dimensional animal-simulating target 44. The second three-dimensional animal-simulating target 44 includes indicia representing one or more vital organs of an animal, such as a deer, bear, fox, etc. According to an exemplary embodiment, the second three-dimensional animal-simulating target 44 provides an outlined representation of the heart 32 and the lung 34, rather than the detailed and anatomically correct representation provided by the first three-dimensional animal-simulating target 30. The outer surface of the second three-dimensional animal-simulating target 44 may be painted, and covered with a UV protectant material, to provide an even more realistic appearance.

Similar to the first three-dimensional animal-simulating target 30, the second three-dimensional animal-simulating target 44 outwardly extends from the second central region 40. According to an exemplary embodiment, the second three-dimensional animal-simulating target 44 does not extend in an outwardly direction a distance beyond the second border region 42. According to the embodiment illustrated, the highest point of the second three-dimensional animal-simulating target 44 extends outwardly from the second central region 40 a distance that is substantially the same as a distance that the second border region 42 extends outwardly from the second central region 40.

Figure 6:
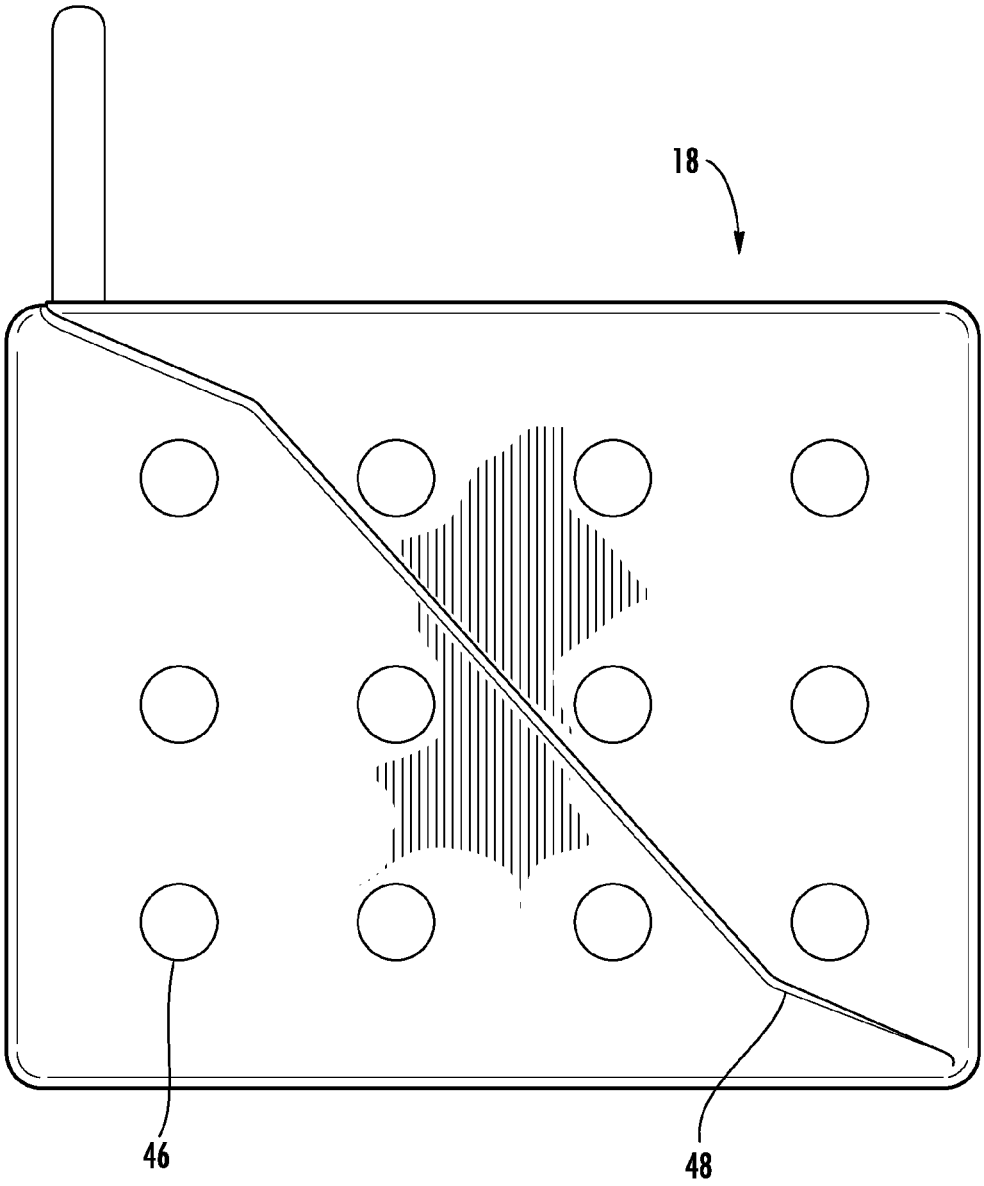
FIG. 6 is an elevation view of a third side of the archery target of FIG. 1 shown according to an exemplary embodiment.

Referring to FIG. 6, the third side surface 18 of the main target body 12 is shown according to an exemplary embodiment. The third side surface 18 is a substantially flat planar surface that extends between the first side surface 14 and the second side surface 16. The third side surface 18 includes a third target zone for an archer. The third target zone includes a plurality of target marks 46 (e.g., bulls eyes, etc.) disposed thereon. According to the embodiment illustrated, there are twelve target marks 46 disposed on the third side surface 18. The size and location of the target marks 46 may be particularly suitable for an archer seeking to practice consistent arrow shooting and placement. While the target marks 46 are shown as being substantially of equal size and shape (i.e., circular), the shapes and sizes of the marks may be varied. According to an exemplary embodiment, the target marks 46 are painted on an outer surface of the third side surface 18, but alternatively, may be a decal or other object coupled to the third side surface 18. According to the embodiment illustrated, the target marks 46 are painted with a partially reflective material so that target marks 46 will visible to an archer even in low light conditions. The line extending substantially diagonally across the third side surface 18 is a parting line 48 from the mold used to cast the main target body 12. Such a line may be eliminated and/or repositioned depending on the molding technique used to form the main target body 12.

Figure 7:
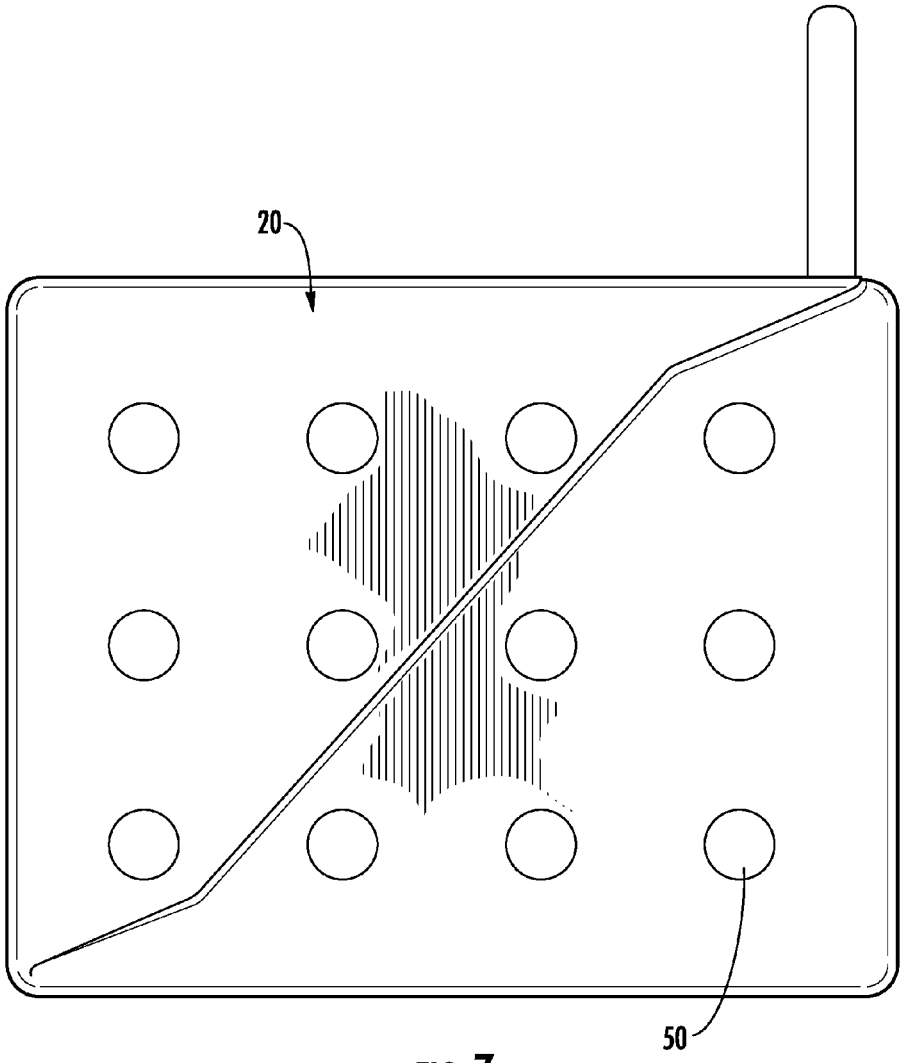
FIG. 7 is an elevation view of a fourth side of the archery target of FIG. 1 shown according to an exemplary embodiment.

Referring to FIG. 7, the fourth side surface 20 of the main target body 12 is shown according to an exemplary embodiment. The fourth side surface 20 is substantially the same as the third side surface 18. Similar to the third side surface 18, the fourth side surface 20 is a substantially flat planar surface that extends between the first side surface 14 and the second side surface 16. The fourth side surface 20 is provided on the archery target 10 on a side opposite the third side surface 18. The fourth side surface 20 includes a fourth target zone for an archer. The fourth target zone includes a plurality of target marks 50 (e.g., bulls eyes, etc.) disposed thereon. According to the embodiment illustrated, there are twelve target marks 50 disposed on the fourth side surface 20. The size and location of the target marks 50 may be particularly suitable for an archer seeking to practice consistent arrow shooting and placement. While the target marks 50 are shown as being substantially of equal size and shape (i.e., circular), the shapes and sizes of the marks may be varied. According to an exemplary embodiment, the target marks 50 are painted on an outer surface of the fourth side surface 20, but alternatively, may be a decal or other object coupled to the fourth side surface 20. According to the embodiment illustrated, the target marks 50 are painted with a partially reflective material so that target marks 50 will visible to an archer even in low light conditions.

Figure 8:
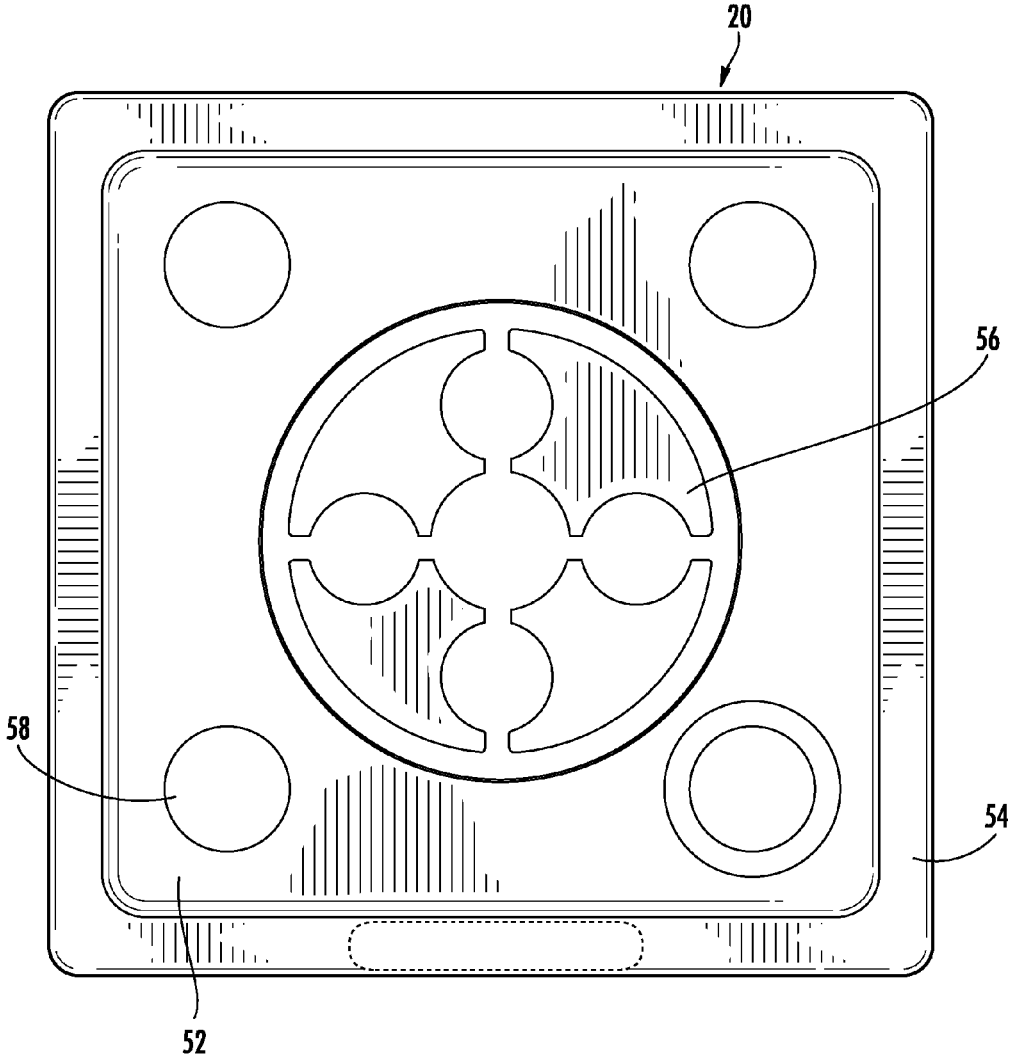
FIG. 8 is an elevation view of a fifth side of the archery target of FIG. 1 shown according to an exemplary embodiment.

Referring to FIG. 8, the fifth side surface 22 of the main target body 12 is shown according to an exemplary embodiment. The fifth side surface 22 extends between the first side surface 14 and the second side surface 16 and includes a fifth target zone for an archer. The fifth target zone includes a third central region 52 that is at least partially surrounded by a third border region 54. According to an exemplary embodiment, the third central region 52 is recessed relative to the third border region 54. In other words, the third border region 54 gives the appearance of being extended outwardly from the third central region 52. The third border region 54 is shown as extending continuously around the entire periphery of the fifth side surface 22. According to the various alternative embodiments, the third border region 54 may only extend partially (e.g., intermittently, etc.) around the fifth side surface 22 or may be eliminated entirely.

The third central region 52 has a planar surface shown as being a substantially flat surface. Provided on the third central region 52 are a plurality of target marks (e.g., bulls eyes, etc.) disposed thereon. Specifically, the target marks are shown as a main or central target mark 56 and four smaller target marks 58. Each of the marks is shown as being substantially circular in shape. The larger central target mark 56 may be particularly suitable for an archer seeking to practice honing, while the smaller target marks 58 may be particularly suitable for an archer seeking to practice consistent arrow shooting and placement. According to the various alternative embodiments, the shapes and sizes of the targets marks may be varied and/or relocated. According to an exemplary embodiment, the target marks 56, 58 are painted on an outer surface of the fifth side surface 22, but alternatively, may be a decal or other object coupled to the fifth side surface 22. According to the embodiment illustrated, the target marks 56, 58 are painted with a partially reflective material so that the target marks 56, 58 will visible to an archer even in low light conditions.

Figure 9:
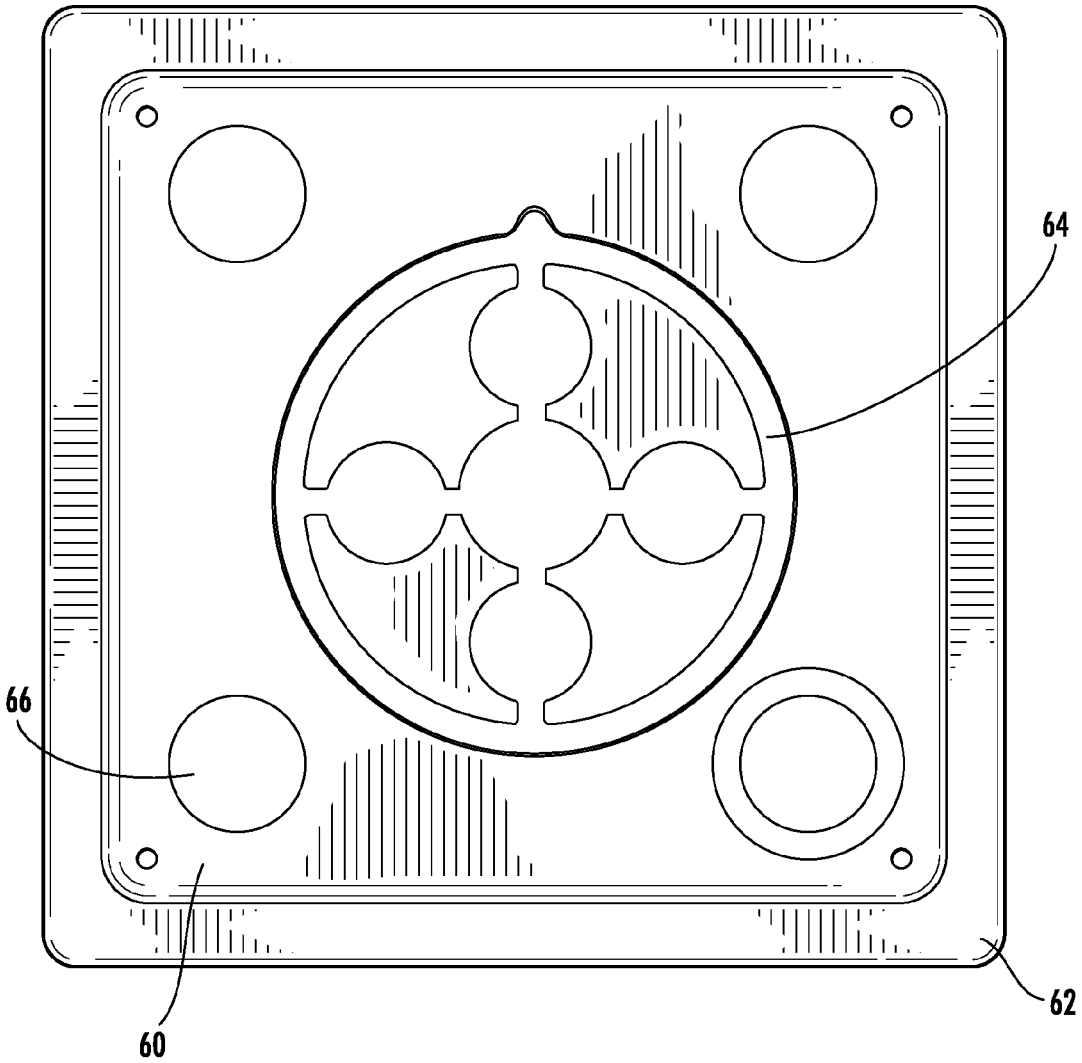
FIG. 9 is an elevation view of a sixth side of the archery target of FIG. 1 shown according to an exemplary embodiment.

Referring to FIG. 9, the sixth side surface 24 of the main target body 12 is shown according to an exemplary embodiment. The sixth side surface 24 is substantially the same as the fifth side surface 22. Similar to the fifth side surface 22, the sixth side surface 24 extends between the first side surface 14 and the second side surface 16. The sixth side surface 24 is provided on the archery target 10 on a side opposite the fifth side surface 22. The sixth side surface 24 includes a sixth target zone for an archer. The sixth target zone includes a fourth central region 60 that is at least partially surrounded by a fourth border region 62. According to an exemplary embodiment, the fourth central region 60 is recessed relative to the fourth border region 62. In other words, the fourth border region 62 gives the appearance of being extended outwardly from the fourth central region 60. The fourth border region 62 is shown as extending continuously around the entire periphery of the sixth side surface 24. According to the various alternative embodiments, the fourth border region 62 may only extend partially (e.g., intermittently, etc.) around the sixth side surface 24 or may be eliminated entirely.

The fourth central region 60 has a planar surface shown as being a substantially flat surface. Provided on the fourth central region 60 are a plurality of target marks (e.g., bulls eyes, etc.). Specifically, the target marks are shown as a main or central target mark 64 and four smaller target marks 66. Each of the marks is shown as being substantially circular in shape. The larger central target mark 64 may be particularly suitable for an archer seeking to practice honing, while the smaller target marks 66 may be particularly suitable for an archer seeking to practice consistent arrow shooting and placement. According to the various alternative embodiments, the shapes and sizes of the targets marks may be varied and/or relocated. According to an exemplary embodiment, the target marks 64, 66 are painted on an outer surface of the sixth side surface 24, but alternatively, may be a decal or other object coupled to the sixth side surface 24. According to the embodiment illustrated, the target marks 64, 66 are painted with a partially reflective material so that the target marks 64, 66 will visible to an archer even in low light conditions.

Referring back to FIGS. 1 and 2, to facilitate portability of the archery target 10, the archery target 10 includes a carrying handle 70 that is configured to be grasped by an archer when it is desirable to move the archery target 10 between various locations. According to an exemplary embodiment, the carrying handle 70 is coupled to the main target body 12. According to the embodiment illustrated, the carrying handle 70 is formed of stranded rope with ends that become embedded in the foam as the main target body 12 is being cast in the mold. The carrying handle 70 may be located at any position that can be readily accessed by an archer. So that the carrying handle 70 does not substantially interfere with the numerous target zones, the carrying handle 70 is preferably coupled to the main target body 12 at a transition between adjacent side surfaces. According to the embodiment illustrated, the carrying handle 70 is coupled to the main target body 12 at a transition between the fifth side surface 22 and the second side surface 16.

With use, certain portions of the archery target 10 are likely to receive many more projectile strikes than other portions of the archery target 10. Such target portions of the archery target 10 may correspond, for example, to portions corresponding to intended target areas. Such target portions will tend to deteriorate more rapidly, due to repeated projectile strikes, than other portions of the archery target 10. To alleviate the need to replace the entire archery target 10 after the useful life of certain target portions have been exceeded, the archery target 10 may include one or more replaceable target sections. The replaceable target sections may allow at least a portion of the archery target 10 to be restored to a useful condition without requiring replacement of the entire archery target 10. The use of a replaceable target section may increase the useful life of and, therefore, reduces the overall cost of maintaining an archery target.

Figure 10:
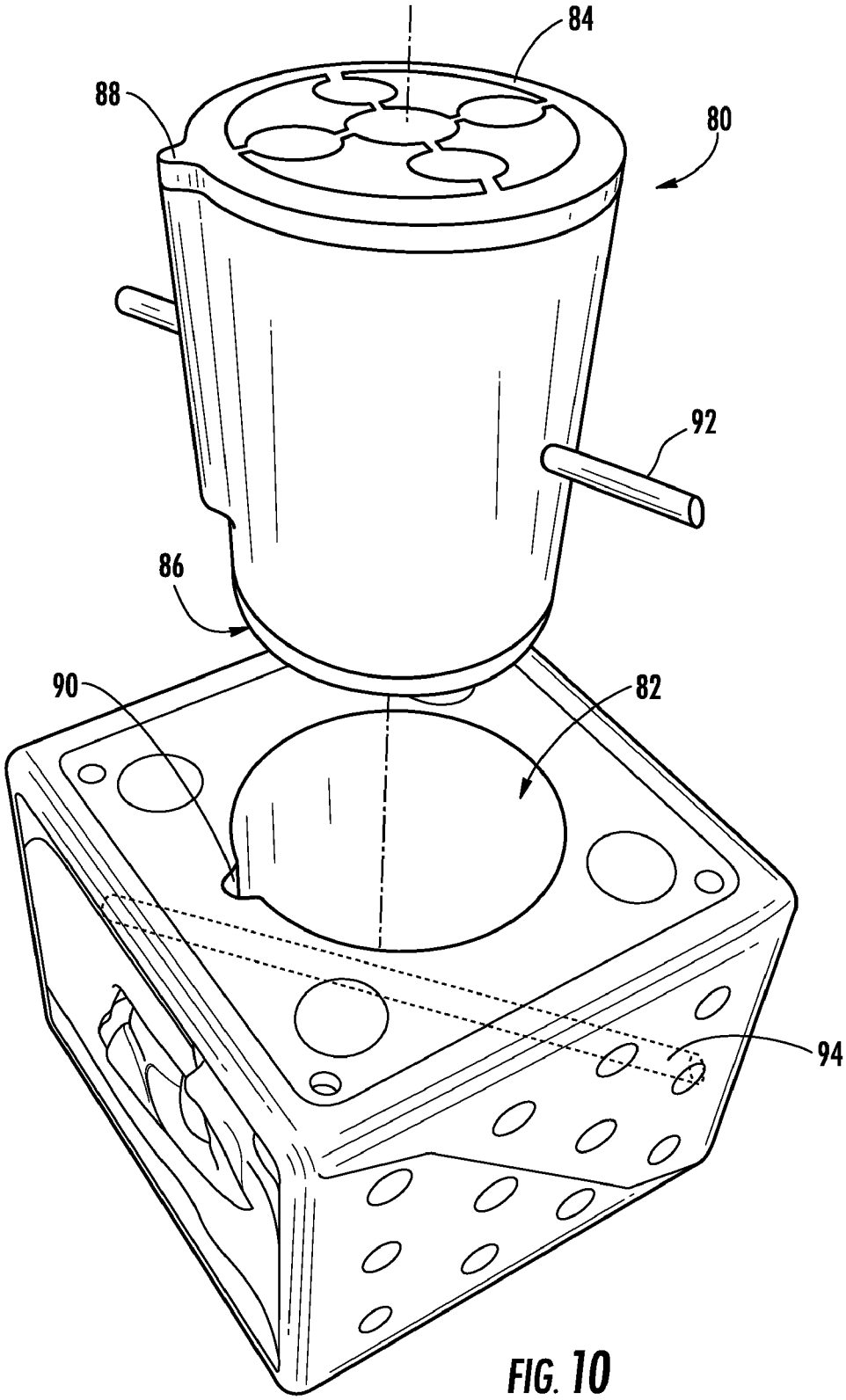
FIG. 10 is an exploded view of the archery target shown in FIG. 1.

Referring to FIG. 10, the archery target 10 is shown as including a replaceable target insert 80. The replaceable target insert 80 is received within an aperture 82 formed in the main target body 12. The aperture 82 is shown as extending entirely through the main target body 12 such that when the replaceable target insert 80 is positioned in the aperture 82, opposing outside ends 84 and 86 of the replaceable target insert 80 define part of the outer surfaces of the fifth side surface 22 and the sixth side surface 24 respectively. Accordingly to the various alternative embodiments, the aperture 82 may only extend partially into the main target body 12 such that when the replaceable target insert 80 is positioned in the aperture 82, only one end of the replaceable target insert 80 defines a portion of the outer surface of the archery target 10.

The aperture 82 may be formed in the main target body 12 during the process of forming (e.g., molding, etc.) the main target body 12, or alternatively, may be formed after the main target body 12 is formed by removing material from the main target body 12. The outside ends 84 and 86 of the replaceable target insert 80 are preferably formed with the appropriate contours and texture such that the replaceable target insert 80 at least partially blends into the main target body 12 when received within aperture 82. According to the embodiment illustrated, the outside end 84 is substantially flat and defines the target mark 56 disposed on the fifth side surface 22, while the outside end 86 is substantially flat and defines the target mark 66 disposed on the sixth side surface 24.

The replaceable target insert 80 may made of the same foam material as the main target body 12, or alternatively, may be made of a more dense or less dense material. The outside ends 84 and 86 of the replaceable target insert 80 are preferably contoured to substantially conform to (e.g., align with, etc.) the contours of the fifth side surface 22 and the sixth side surface 24 respectively when the replaceable target insert 80 is received within the aperture 82. According to the embodiment illustrated, both the ends of the replaceable target insert 80 and the fifth and sixth side surfaces 22 and 24 are substantially flat. According to the various alternative embodiments, one or more of these surfaces may be curved, angled and/or include one or more projections or recesses, etc.

The shape of the replaceable target insert 80 and the corresponding shape of the aperture 82 are preferably designed to facilitate placement of the replaceable target insert 80 within the aperture 82 in the proper orientation. For example, an extending portion, shown as an alignment tab 88, may be formed on a side of the replaceable target insert 80, with a corresponding recess or slot 90 formed in a wall defining the aperture 82. The replaceable target insert 80 will only fit into the aperture 82 when the alignment tab 88 is aligned with the corresponding slot 90. Thus, the alignment tab 88 in combination with the slot 90 facilitate proper orientation of the replaceable target insert 80 within the aperture 82.

According to an exemplary embodiment, the replaceable target insert 80 is detachably coupled to the main target body 12 by one or more support member, shown as a support rod 92, which extends through a support member aperture formed in the replaceable target insert 80 and a corresponding support member aperture 94 formed in the main target body 12. According to the embodiment illustrated, the support rod 92 extends entirely through the replaceable target insert 80 into the aperture 94 formed in the main target body 12 on opposite sides of the aperture 82. The support rod 92 may be hollow or solid, and made of any suitable rigid or semi-rigid material, such as plastic. According to an exemplary embodiment, the support rod 92 is pointed, or slightly pointed, at one end thereof, to facilitate inserting the support rod 92 through the aperture formed in the replaceable target insert 80 and the aperture 94 formed in the main target body 12. Ease of insertion of the support rod 92 is facilitated because of the alignment tab 88, as described previously, which ensures that the aperture formed in the replaceable target insert 80 is substantially aligned with the aperture 94 formed in the main target body 12.

Since the replaceable target insert 80 is likely to receive more projectile strikes than other portions of the archery target 10, it is likely to be deteriorated rapidly. As the replaceable target insert 80 deteriorates, projectiles striking the replaceable target insert 80 may penetrate deeply into the replaceable target insert 80. To prevent or otherwise minimize damage to the tip of the projectile, the support rod 92 may be made of a material which will not substantially damage the head of the projectile, should the projectile penetrate into the replaceable target insert 80 to such a depth as to contact the support rod 92. According to the embodiment illustrated, the support rod 92 is formed of a low density polyethylene.

To facilitate easy removal of the support rod 92 from the main target body 12, one or more ends of the support rod 92 may be configured to extend slightly from the main target body 12 when the support rod 92 is received therein. For example, referring back to FIG. 1, an end of support rod 92 is shown as extending slightly from the fourth side surface 20. This allows the extending end of the support rod 92 to be grasped more easily by hand, or with a pliers, to remove the support rod 92 from the main target body 12 and the replaceable target insert 80.

According to the various alternative embodiments, the archery target 10 may not includes a replacement target insert. In such an embodiment, the main target body 12 may be formed as a substantially solid member, without any aperture provided therein.

It is important to note that the construction and arrangement of the archery target 10 as shown in the exemplary embodiment is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the components of the archery target may be constructed from any of a wide variety of materials that provide sufficient functionality and/or strength or durability. Accordingly, all such modifications are intended to be included within the scope of the present inventions. Other substitutions, modifications, changes and omissions may be made in the design, operating conditions and arrangement of the preferred and other exemplary embodiments without departing from the spirit of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the appended claims.

What is claimed is:

1. A portable archery target comprising:

a main target body having a geometric shape, the geometric shape having a first outer side and a second outer side, the first outer side having a first target zone, the second outer side having a second target zone being separate and distinct from the first target zone, the first target zone having a first three-dimensional animal-simulating indicia, the second target zone having a second three-dimensional animal-simulating indicia;

a first border region and a second border region, the first border region extending at least partially around the first three-dimensional animal-simulating indicia and outwardly extending from the first outer side, the second border region extending at least partially around the second three-dimensional animal-simulating indicia and outwardly extending from the second outer side;

wherein the first three-dimensional animal-simulating indicia extends outwardly from the first outer side a distance that is less than or substantially the same as a distance that the first border region extends from the first outer side, and wherein the second three-dimensional animal-simulating indicia extends outwardly from the second outer side a distance that is less than or substantially the same as a distance that the second border region extends from the second outer side.

2. The portable archery target of claim 1, wherein the first three-dimensional animal-simulating indicia provides an anatomically correct depiction of at least one vital organ of an animal.

3. The portable archery target of claim 2, wherein an outer surface of the first three-dimensional animal-simulating indicia is textured.

4. The portable archery target of claim 2, wherein the second three-dimensional animal-simulating indicia provides an outline of at least one vital organ of an animal.

5. The portable archery target of claim 1, further comprising a third side extending between the first outer side and the second outer side, the third side having a third target zone.

6. The portable archery target of claim 5, further comprising a handle coupled to the main target body at a transition between the third side and one of the first outer side and the second outer side.

7. The portable archery target of claim 5, wherein the third target zone is a substantially flat surface having at least one target marking.

8. A portable target comprising:

a main target body having a first outer side and a second outer side, the first outer side defining a first target zone having a first three-dimensional vital organ-simulating indicia, the second outer side defining a second target zone, having a second three-dimensional vital organ-simulating indicia, the main target body also having a third side defining a third target zone and a fourth side defining a fourth target zone, the third side and the fourth side each having a substantially planar surface; and a replaceable target insert configured to be received within an aperture defined by the third side or the fourth side, the replaceable target insert having a first outer surface that forms at least a portion of the third target zone when received within the aperture, and a second outer surface that forms at least a portion of the fourth target zone.

9. The portable target of claim 8, further comprising a support member configured to be inserted at least partially through the main target body and the replaceable target insert to secure the insert to the main target body.

10. The portable target of claim 8, wherein the replaceable target insert includes an alignment tab corresponding to a recess in a wall defining the aperture.

11. The portable target of claim 8, wherein the main target body is substantially rectangular in shape.

12. The portable target of claim 8, wherein at least one of the first and the second three-dimensional animal-simulating indicia provides an anatomically correct depiction of at least one vital organ of an animal.

13. The portable target of claim 8, wherein at least one of the first and the second three-dimensional animal-simulating indicia provides an outline of at least one vital organ of an animal.

14. The portable target of claim 8, wherein the substantially planar surface of the third and fourth target zones are a substantially flat surface.

15. A method of manufacturing a portable archery target having a replaceable insert, the method comprising:

adding a resin into a first mold cavity, the first mold cavity defining a geometric shape of the portable archery target with an aperture, the first mold cavity having a first surface that defines a first outer target zone and a second surface that defines a second outer target zone, the first surface having a contour that provides a first three-dimensional animal-simulating target, the second surface having a contour that provides a second three-dimensional animal-simulating target, the mold cavity also having a third side defining a third target zone and a fourth side defining a fourth target zone;

closing the first mold cavity to form a first foam body;

removing the first foam body from the first mold cavity;

adding a resin into a second mold cavity, the second mold cavity defining a geometric shape of the replaceable insert, the second mold cavity having a first surface that defines a first outer surface that forms at least a portion of the third target zone, and a second outer surface that forms at least a portion of the fourth target zone;

closing the second mold cavity to form a second foam body; and removing the second foam body from the second mold cavity.

16. The method of claim 15, wherein the first mold cavity defines a substantially rectangular shape for the first foam body and the second mold cavity defines a substantially cylindrical shape for the second foam body that is sized to fit within the aperture in the first foam body.

17. The method of claim 15, further comprising integrally molding a carrying handle at a transition between the first surface and the third surface.

* * * * *